US010462860B2

(12) United States Patent
Yu

(10) Patent No.: US 10,462,860 B2
(45) Date of Patent: Oct. 29, 2019

(54) CONTROLLER FOR SWITCHING REGULATOR, SWITCHING REGULATOR AND LED LIGHTING SYSTEM

(71) Applicant: ELITE SEMICONDUCTOR MEMORY TECHNOLOGY INC., Hsinchu (TW)

(72) Inventor: Tung-Ming Yu, Chiayi (TW)

(73) Assignee: ELITE SEMICONDUCTOR MEMORY TECHNOLOGY INC., Hsinchu (TW)

( * ) Notice: Subject to any disclaimer, the term of this patent is extended or adjusted under 35 U.S.C. 154(b) by 325 days.

(21) Appl. No.: 15/684,502

(22) Filed: Aug. 23, 2017

(65) Prior Publication Data

US 2019/0069358 A1 Feb. 28, 2019

(51) Int. Cl.
*H05B 33/08* (2006.01)

(52) U.S. Cl.
CPC ..... *H05B 33/0815* (2013.01); *H05B 33/0842* (2013.01); *H05B 33/0887* (2013.01)

(58) Field of Classification Search
CPC ..... H05B 33/0815; H05B 33/0842; H05B 33/0887
See application file for complete search history.

(56) References Cited

U.S. PATENT DOCUMENTS 8,659,278 B2 2/2014 Arora et al.
2016/0044757 A1* 2/2016 Koo ..... H05B 33/089 315/297

FOREIGN PATENT DOCUMENTS

JP 2015177594 10/2015

OTHER PUBLICATIONS

English abstract translation of JP2015177594.

* cited by examiner

*Primary Examiner* — Douglas W Owens
*Assistant Examiner* — Pedro C Fernandez
(74) *Attorney, Agent, or Firm* — WPAT, PC

(57) ABSTRACT

A controller for a switching regulator of a LED lighting system has a current monitor, a voltage divider, an integration circuit, and a comparator circuit. The current monitor is used to sense a LED current passing through a current sensing resistor of the switching regulator, and to generate a sensing current. The voltage divider is used to receive the sensing current to generate a first through third divided voltages, wherein the first divided voltage is larger than the second divided voltage, and the second divided voltage is larger than the third divided voltage. The integration circuit is used to compare the second divided voltage with a reference voltage, and to generate an integration voltage across a RC circuit thereof accordingly. The comparator circuit is used to compare the integration voltage with the first divided voltage and the third divided voltage, and to generate a driving signal.

20 Claims, 3 Drawing Sheets

CONTROLLER FOR SWITCHING REGULATOR, SWITCHING REGULATOR AND LED LIGHTING SYSTEM

FIELD OF THE INVENTION

The present disclosure relates to a switching regulator used in a light source, in particular, to a controller for a switching regulator, and further to the switching regulator and a light emitting diode (LED) lighting system using said controller.

BACKGROUND OF THE INVENTION

A LED lighting system includes a switching regulator and a LED, wherein the switching regulator has a controller therein. The switching regulator is controlled by the controller thereof to provide a current to the LED. The controller includes components to calculate an actual charge amount delivered to the LED system according to the current and an active time period of an LED current time period, wherein the LED current time period is duty cycle modulated at a rate of greater than fifty (50) Hz and to utilize the actual charge amount to modify and provide a desired target charge amount to be delivered during a future active time period of the LED current time period.

The LED system further has components to calculate the active time period of the LED current time period an actual charge amount delivered to the LED system, and also has components to compare the actual charge amount with a desired charge amount for the active time period of the LED current time period, and to compensate a difference between the actual charge amount and the desired charge amount during the future active time period. In order to accurately control the desired charge amount, the average LED current should be controlled well, and the light intensity of the LED should be effectively controlled.

Unfortunately, some conventional switching regulator used in the LED system has a logic gate and a gate driver (or called pre-driver), and thus a delay issue occurs, such that the average LED current cannot be controlled easily. Furthermore, the inductance of the inductor used in the switching regulator and the ratio of the input voltage and the output voltage (i.e. regulator output) of the LED lighting system may also affect the control of the average LED current.

Please refer FIG. 1. FIG. 1 is a block diagram of a conventional LED lighting system. The conventional LED light system comprises a switching regulator and a LED 12, wherein the switching regulator is a buck type regulator, and comprises a controller 10, a first current sensing resistor 11, a second current sensing resistor 13, a Zener diode 14, and an inductor L. The controller 10 is connected to the first current sensing resistor 11, the LED 12, the second current sensing resistor 13, the Zener diode 14, and the inductor L. One end of the first current sensing resistor 11 is used to receive an input voltage Vin, and other one end of the first current sensing resistor 11 is connected to one end of the inductor L. Anode of the Zener diode 14 is connected to other one end of the inductor L, and cathode of the Zener diode 14 is connected to one end of the second current sensing resistor 13. Anode and cathode of the LED 12 are respectively connected to other one end of the second current sensing resistor 13 and a ground GND.

The controller comprises an error signal generation circuit 101, a fast current monitor 102, a hysteresis controller 103, a resistor 104, a hysteresis comparator 105, a gate driver 106, and a switching NMOS transistor 107. The fast current monitor 102 is parallel connected to the first current sensing resistor 11 to sense a voltage across the first current sensing resistor 11 and generate a first sensing current accordingly. The error signal generation circuit 101 is parallel connected to the second current sensing resistor 13 to sense a voltage across the second current sensing resistor 13 and generate an error signal accordingly, wherein the error signal represents the error between a desired regulator output and an actual regulator output.

The hysteresis controller 103 is connected to a negative input terminal and an output end of the hysteresis comparator 105, and an positive input end of hysteresis comparator 105 and the hysteresis controller 103 receive a reference voltage Vref, such that the hysteresis controller 103 and the hysteresis comparator 105 form a hysteretic comparator for controlling the on/off state of the switching NMOS transistor 107. The negative input end of the hysteresis comparator 105 is further to receive a voltage across the resistor 104, wherein two ends of the resistor 104 are respectively connected the negative input end of the hysteresis comparator 105 and the ground GND, and the voltage across the resistor 104 is formed according to the error signal, the first sensing current, and the hysteresis control signal output by the hysteresis controller 103. The gate driver 106 is used to receive the output signal of the hysteresis comparator 105 to generate a driving signal to a gate end of the switching NMOS transistor 107. A drain end and a source end of the switching NMOS transistor 107 are respectively connected to the other one end of the inductor L and the ground GND.

The error signal generation circuit 101 comprises an integrator 1011, an accurate current monitor 1012, a subtracting unit 1013, and a demand current source 1014. The accurate current monitor 1012 is parallel connected to the second current sensing resistor 13 for sense the voltage across the second current sensing resistor 13, so as to generate a second sensing current accordingly. The subtracting unit 1013 are connected to the integrator 1011 and the demand current source 1014, and used to subtract the demand current from the second sensing current to generate the subtraction current to the integrator 1011. The demand current source 1014 is used to receive the reference voltage Vref to generate a demand current accordingly. The integrator 1011 is further connected to the negative input end of the hysteresis comparator 105, and used to integrate the subtraction current to generate the error signal. The error signal is the integration of the subtraction of demand current and the second sensing current, and this means the error signal represents the error between the desired regulator output and the actual regulator output.

It is noted that though the conventional the switching regulator and its controller 10 can solve the above problems for affecting the average LED current, two current monitors (i.e. the fast current monitor 102 and the accurate current monitor 1012) are required, and thus increasing the circuit hardware cost, especially the accurate current monitor 1012. A simpler circuit of the switching regulator and its controller are still demanded by the market.

SUMMARY OF THE INVENTION

An exemplary embodiment of the present disclosure provides a controller for a switching regulator of a LED lighting system comprising a current monitor, a voltage divider, an integration circuit, and a comparator circuit. The current monitor is used to sense a LED current passing through a current sensing resistor of the switching regulator, and to generate a sensing current. The voltage divider is connected to the current monitor, and used to receive the sensing current to generate a first through third divided voltages, wherein the first divided voltage is larger than the second divided voltage, and the second divided voltage is larger than the third divided volt. The integration circuit is connected to the voltage divider, and used to compare the second divided voltage with a reference voltage, and to generate an integration voltage across a RC circuit thereof accordingly. The comparator circuit is connected to the integration circuit and the voltage divider, and used to compare the integration voltage with the first divided voltage and the third divided voltage, and to generate a driving signal.

An exemplary embodiment of the present disclosure provides a switching regulator comprising the above controller.

An exemplary embodiment of the present disclosure provides a LED lighting system comprising the above switching regulator.

To sum up, the provided controller for the switching regulator of the LED lighting system can solve the problems that the actual average LED current departs away from the desired average LED current.

In order to further understand the techniques, means and effects of the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION OF THE PREFERRED EMBODIMENTS

Figure 1:
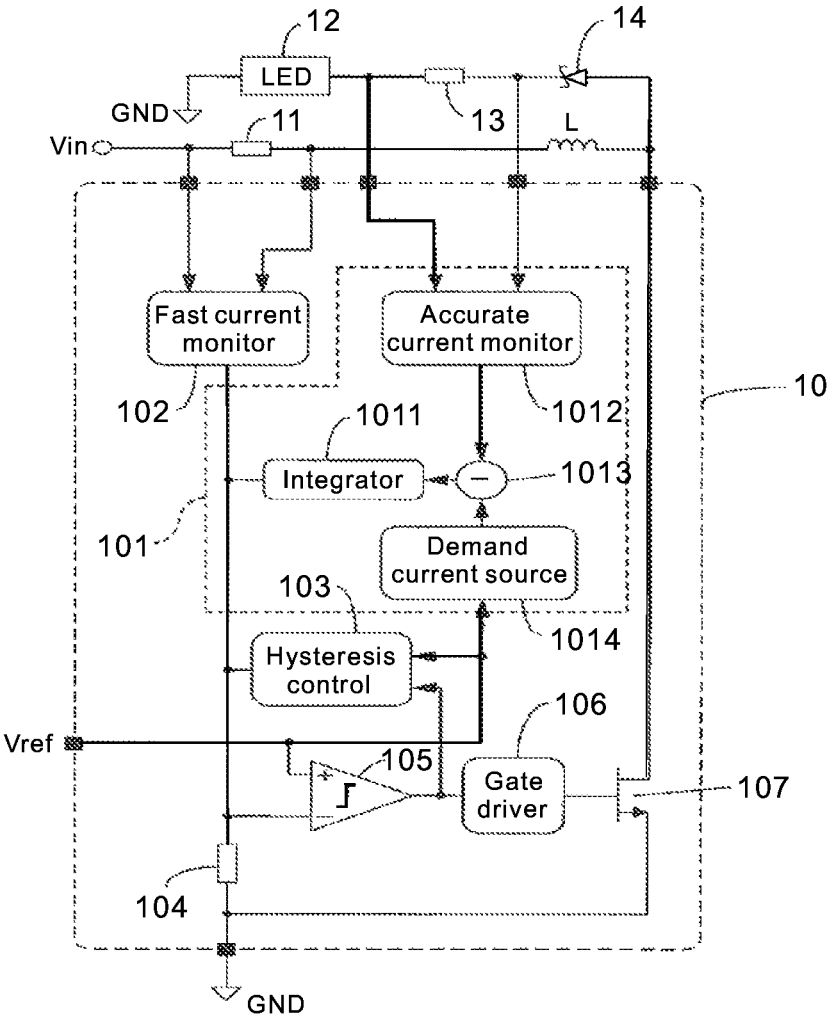
FIG. 1 (PRIOR ART)
FIG. 1 is a schematic diagram of a conventional controller for the switching regulator in a light source.

Reference will now be made in detail to the exemplary embodiments of the present disclosure, examples of which are illustrated in the accompanying drawings. Wherever possible, the same reference numbers are used in the drawings and the description to refer to the same or like parts.

An exemplary embodiment of the present disclosure provides a controller for a switching regulator (p.s. the switching regulator is a buck type regulator) in a LED lighting system. The controller has a current monitor, a voltage divider, an integrator, and a comparator circuit. The current monitor is parallel connected to a current sensing resistor which a LED current passing through the LED. The voltage divider is connected to the current monitor to receive a sensing current output by the current monitor. The voltage divider is used to generate a first divided voltage, a second divided voltage, and a third divided voltage according to the sensing current, wherein the first divided voltage is larger than the second divided voltage, and the second divided voltage is larger than the third divided voltage.

The integrator circuit is connected to the voltage divider and the comparator circuit, and is used to compare the second divided voltage and a reference voltage to generate an integration voltage across a RC integration circuit which has a resistor and a capacitor connected in a serial manner. The comparator circuit is connected to the voltage divider, and the to compare the integration voltage with the first divided voltage and the third divided voltage, so as to generate a driving signal to control a switching NMOS transistor to regulate the LED current.

By using the integrator circuit, the non-ideal effects on the desired average LED current can be reduced. Specifically, influences of the delay of the logic circuit, the inductance of the inductor, and the ratio of the input voltage and the output voltage (i.e. the regulator output) of the LED lighting system can be compensated, such that the actual average LED current is approximate to the desired average current, i.e. non-ideal effects exist. Furthermore, the forward voltage of the LED is also has no effect on the actual average LED current by using the integrator circuit.

Figure 2:
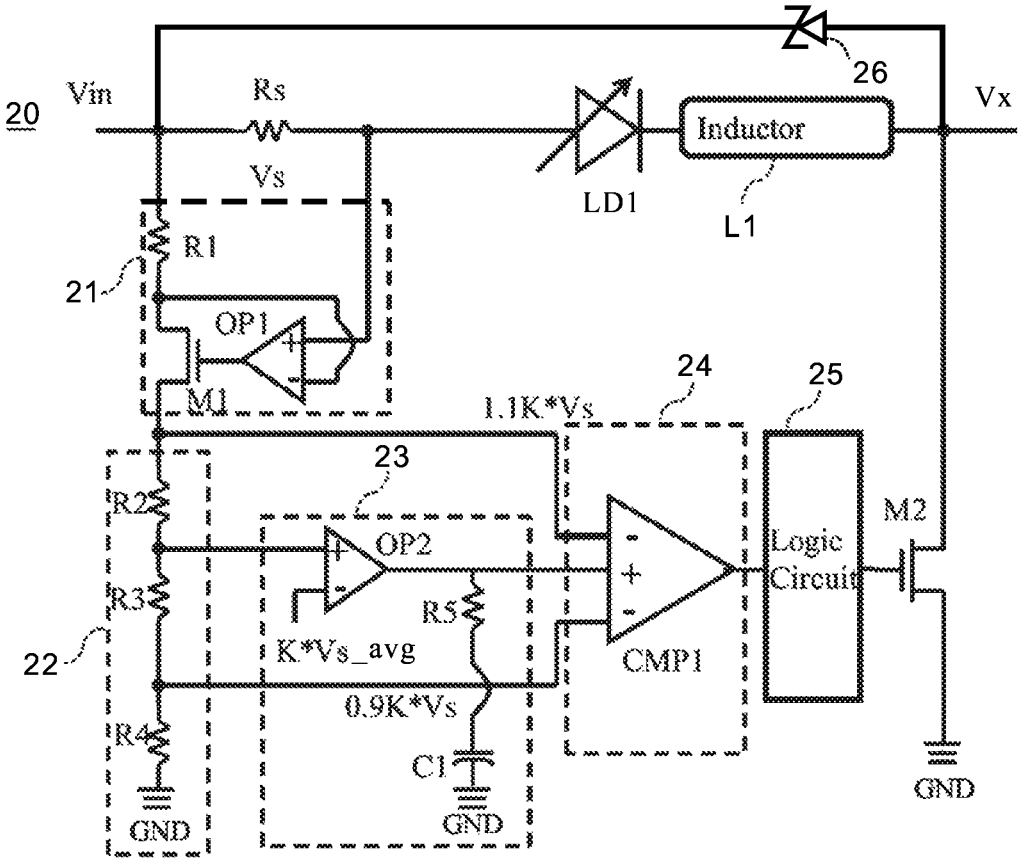
FIG. 2 is a schematic diagram of a controller for a switching regulator in a LED lighting system according to an exemplary embodiment of the present disclosure.

Please refer to FIG. 2, FIG. 2 is a schematic diagram of a controller for a switching regulator in a LED lighting system according to an exemplary embodiment of the present disclosure. The LED lighting system 20 in FIG. 2 comprises a switching regulator and a LED LD1, wherein the switching regulator is connected to the LED LD1 to regulate a LED current passing through the LED LD1.

The switching regulator comprises a controller, a current sensing resistor Rs, an inductor L1, and a Zener diode 26. The controller herein comprises a current monitor 21, a voltage divider 22, an integrator circuit 23, a comparator circuit 24, a logic circuit 25, and a switching NMOS transistor M2. The controller is used to control the switching regulator to regulate the LED current, such that the actual average LED current can be expected.

An input voltage Vin is applied on one end of the current sensing resistor Rs. An anode of the LED LD1 is connected to other one end of the current sensing resistor Rs, and a cathode of the LD1 is connected to one end of the inductor L1. An anode and a cathode of the Zener diode 26 are respectively connected to other one end of the inductor L1 and the end of current sensing resistor Rs. The other one end of the inductor L1 is used to generate the regulator output Vx.

The current sensing resistor Rs is parallel connected to the current monitor 21, i.e. the two ends of the current sensing resistor Rs are connected to input ends of the current monitor 21. The voltage divider 22 is connected to an output end of the current monitor 21. Two input ends of integrator circuit 23 are respectively connected to an internal end of the voltage divider 22 and applied with a reference voltage K*Vs_avg, wherein K is a constant number, and Vs_avg is the average of the voltage Vs across the current sensing resistor Rs. Three input ends of the comparator circuit 24 are respectively connected to an input end of the voltage divider 22, another one internal end of the voltage divider 22, and an output end of the integrator circuit 23.

An input end and an output end of the logic circuit 25 are respectively connected to an output end of the comparator circuit 24 and a gate end of the switching NMOS transistor M2, and a drain end and a source end of the switching NMOS transistor M2 are respectively connected to the other end of the inductor L1 and a ground GND.

The current monitor 21 is used to receive the voltage Vs across the current sensing resistor Rs, and thus the LED current passing through the current sensing resistor Rs is sensed by the current monitor 21. The current monitor 21 thus outputs a sensing current according to the LED current. The current monitor 21 can be implemented by a resistor R1, an operation amplifier OP1, and NMOS transistor M1, and the present disclosure is not limited thereto.

One end of the resistor R1 is connected to the end of the current sensing resistor Rs, and a positive input end and a negative input end of the operation amplifier OP1 are respectively connected to the other one end of the current sensing resistor Rs and other one end of the resistor R1. An output end of the operation amplifier OP1 is connected to a gate end of the NMOS transistor M1, and a drain end and a source end of the NMOS transistor are respectively connected to the other one end of the resistor R1 and an input end of the voltage divider 22.

By connections of the components of current monitor 21 mentioned above, the negative feedback loop exists in the current monitor 21, and thus the sensing current in fact is about Vs/R1. The voltage divider 22 is used to receive the sensing current and generate a first through third divided voltages on its input end and two internal ends, wherein the first divided voltage is larger than the second divided voltage, and the second divided voltage is larger than the second divided voltage.

The voltage divider 22 can be implemented by serially connected resistors R1, R2, and R3, and the present disclosure is not limited thereto. The first divided voltage in fact is about (Vs/R1)*(R1+R2+R3), the second divided voltage in fact is about (Vs/R1)*(R2+R3), and the third divided voltage in fact is about (Vs/R1)*R3. When the resistors R1, R2, R3 are designed well, the first through third divided voltages are about 1.1K*Vs, K*Vs, and 0.9K*V, wherein K is (R2+R3)/R1.

The integrator circuit 23 compares the second divided voltage (i.e. K*Vs) with the reference voltage K*Vs_avg, and thus according to the comparison result to generate the integration voltage. Specifically, when the second divided voltage is larger than the reference voltage, an positive voltage is applied on the RC circuit of the integrator circuit 23, such that the integration voltage across the RC circuit is increased; when the second divided voltage is not larger than the reference voltage an negative voltage is applied on the RC circuit of the integrator circuit 23, such that the integration voltage across the RC circuit is decreased.

The integrator circuit 23 can be implemented by an operation amplifier OP2, a resistor R5, and a capacitor C1. The resistor R5 and the capacitor C1 are connected serially to form the RC circuit. A positive input end of the operation amplifier OP2 is connected to the internal end of the voltage divider 22 to receive the second divided voltage, a negative input end of the operation amplifier OP2 is applied with the reference voltage K*Vs_avg, and an output end of the operation amplifier OP2 is connected to an positive input end of the comparator circuit 24. One end of the resistor R5 is connected to the output end of the operation amplifier OP2, and two ends of the capacitor C1 are respectively connected to other one end of the resistor R5 and the ground GND.

The comparator circuit 24 compares the integration voltage with the first and second divided voltages, and thus outputs the driving signal. The comparator circuit 24 can be implemented by a comparator CMP1 with two negative input ends and one positive input end, and the present disclosure is not limited thereto. The two negative input ends of the comparator CMP1 are respectively connected to the input end and other one internal end of the voltage divider 22, and the positive input end of comparator CMP1 is connected to the output end of the integration circuit 23. The output end of the comparator CMP1 is connected to an input end of the logic circuit 25.

The logic circuit 25 having a plurality of logic gates is used to receive the driving signal and generate a switching signal on its output end accordingly, so as to control the on/off state of the switching NMOS transistor M2. When the integration voltage is less than the third divided voltage, the switching NMOS transistor M2 is turned off, and the LED current is increased. When the integration voltage is larger than first divided voltage, the switching NMOS transistor M2 is turned on, and the LED current is decreased.

Figure 3:
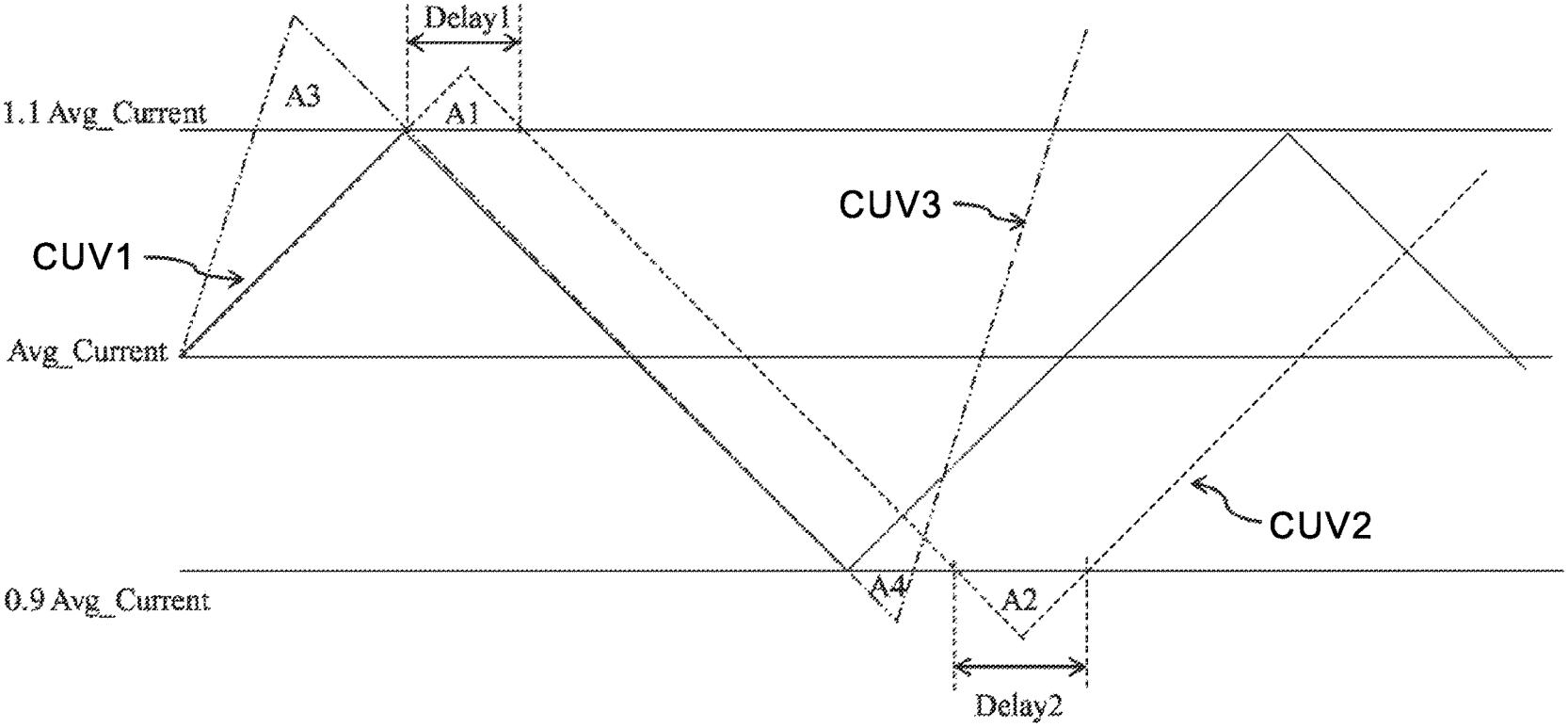
FIG. 3 is a schematic wave diagram of non-ideal LED currents without using the provided controller and the actual LED current using the provided controller according to an exemplary embodiment of the present disclosure.

Please refer to FIG. 3. FIG. 3 is a schematic wave diagram of non-ideal LED currents without using the provided controller and the actual LED current using the provided controller according to an exemplary embodiment of the present disclosure. The non-ideal LED current curve CUV2 shows that the on and off delays delay1, delay2 of the switching NMOS transistor M2 affect the average LED current. It is noted that the on delay and the off delay are not identical to each other, and the areas A1 and A2 shown in FIG. 3 are not identical to each other, such that the actual average LED current cannot be the desired current value Avg_Current.

Further considering the ratio of the input voltage and the output voltage (i.e. regulator output Vx) of the LED lighting system, the non-ideal LED current is shown as the non-ideal LED current curve CUV3, wherein the slope of the non-ideal LED current curve CUV3 is (Vin-Vout)/L when the switching NMOS transistor M2 is turned off, and the slope of the non-ideal LED current curve CUV3 is Vout/L when the switching NMOS transistor M2 is turned on. It is noted that the areas A3 and A4 shown in FIG. 3 due to the above influences are not identical to each other, and thus the actual average LED current cannot be the desired current value Avg_Current. However, by using the integrator circuit, the non-ideal effects on the desired average LED current can be reduced, and the actual LED current curve can be similar to the ideal LED current curve CUV1.

Accordingly, in the exemplary embodiment of the present disclosure, the provided controller for the switching regulator of the LED lighting system can solve the problems that the actual average LED current departs away from the desired average LED current. The delays, the input voltage, the regulator output, and even the forward voltage of the LED cannot affect the actual average LED.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A controller for a switching regulator of a LED lighting system, comprising:

a current monitor, used to sense a LED current passing through a current sensing resistor of the switching regulator, and to generate a sensing current; and a voltage divider, connected to the current monitor, used to receive the sensing current to generate a first through third divided voltages, wherein the first divided voltage is larger than the second divided voltage, and the second divided voltage is larger than the third divided voltage;

an integration circuit, connected to the voltage divider, used to compare the second divided voltage with a reference voltage, and to generate an integration voltage across a RC circuit thereof accordingly; and a comparator circuit, connected to the integration circuit and the voltage divider, used to compare the integration voltage with the first divided voltage and the third divided voltage, and to generate a driving signal.

2. The controller according to claim 1, wherein the current monitor comprises:

a first resistor, one end thereof is connected to an input voltage and one end of the current sensing resistor;

a first operation amplifier, a positive input end thereof is connected to other one end of the current sensing resistor, and a negative input end thereof is connected to other one end of the first resistor; and a NMOS transistor, a drain end thereof is connected to the other one end of the first resistor, a source end is connected to the voltage divider, and a gate end thereof is connected to an output end of the first operation amplifier.

3. The controller according to claim 1, wherein the voltage divider comprises a second through fourth resistor which are connected in a serial manner.

4. The controller according to claim 1, wherein the integration circuit comprises the RC circuit and a second operation amplifier, wherein an positive input end of the second operation amplifier is used to receive the second divided voltage, a negative input end of the second operation amplifier is used to receive the reference voltage, and an output end of the second operation amplifier is connected to the RC circuit.

5. The controller according to claim 1, wherein the comparator circuit comprises a comparator with a positive input end and two negative input ends, wherein the positive input end of the comparator is used to receive the integration voltage, and two negative input ends of the comparator are used to receive the first divided voltage and the second divided voltage.

6. The controller according to claim 4, further comprising:

a logic circuit, connected to the comparator circuit, used to receive the driving signal, and to generate a switching signal accordingly; and a switching NMOS transistor, a gate end thereof is used to receive the switching signal, and a drain end thereof is connected an inductor of the switching regulator, wherein a LED of the LED lighting system is connected between the current sensing resistor and the inductor.

7. The controller according to claim 6, wherein when the second divided voltage is larger than the reference voltage, the integration voltage is increased, when the second divided voltage is not larger than the reference voltage, the integration voltage is decreased; when the integration voltage is larger than first divided voltage, the switching NMOS transistor is turned on, and the LED current is decreased, when the integration voltage is less than third divided voltage, the switching NMOS transistor is turned off, and the LED current is increased.

8. A switching regulator of a LED lighting system, comprising:

a controller;

a current sensing resistor, one end thereof is used to receive a input voltage, and other one end thereof is connected to an anode of a LED of the LED lighting system;

an inductor, one end thereof is connected to a cathode of the LEDD; and a Zener diode, an anode and a cathode thereof are respectively connected to other one end of the inductor and the end of the current sensing resistor;

wherein the controller is connected to the current sensing resistor and the other one end of the inductor, and the controller comprises:

a current monitor, used to sense a LED current passing through the current sensing resistor, and to generate a sensing current; and a voltage divider, connected to the current monitor, used to receive the sensing current to generate a first through third divided voltages, wherein the first divided voltage is larger than the second divided voltage, and the second divided voltage is larger than the third divided voltage;

an integration circuit, connected to the voltage divider, used to compare the second divided voltage with a reference voltage, and to generate an integration voltage across a RC circuit thereof accordingly; and a comparator circuit, connected to the integration circuit and the voltage divider, used to compare the integration voltage with the first divided voltage and the third divided voltage, and to generate a driving signal.

9. The switching regulator according to claim 8, wherein the current monitor comprises:

a first resistor, one end thereof is connected to an input voltage and one end of the current sensing resistor;

a first operation amplifier, a positive input end thereof is connected to other one end of the current sensing resistor, and a negative input end thereof is connected to other one end of the first resistor; and a NMOS transistor, a drain end thereof is connected to the other one end of the first resistor, a source end is connected to the voltage divider, and a gate end thereof is connected to an output end of the first operation amplifier.

10. The switching regulator according to claim 8, wherein the voltage divider comprises a second through fourth resistor which are connected in a serial manner.

11. The switching regulator according to claim 8, wherein the integration circuit comprises the RC circuit and a second operation amplifier, wherein an positive input end of the second operation amplifier is used to receive the second divided voltage, a negative input end of the second operation amplifier is used to receive the reference voltage, and an output end of the second operation amplifier is connected to the RC circuit.

12. The switching regulator according to claim 8, wherein the comparator circuit comprises a comparator with a positive input end and two negative input ends, wherein the positive input end of the comparator is used to receive the integration voltage, and two negative input ends of the comparator are used to receive the first divided voltage and the second divided voltage.

13. The switching regulator according to claim 11, further comprising:

a logic circuit, connected to the comparator circuit, used to receive the driving signal, and to generate a switching signal accordingly; and a switching NMOS transistor, a gate end thereof is used to receive the switching signal, and a drain end thereof is connected an inductor of the switching regulator, wherein a LED of the LED lighting system is connected between the current sensing resistor and the inductor.

14. The switching regulator according to claim 13, wherein when the second divided voltage is larger than the reference voltage, the integration voltage is increased, when the second divided voltage is not larger than the reference voltage, the integration voltage is decreased; when the integration voltage is larger than first divided voltage, the switching NMOS transistor is turned on, and the LED current is decreased, when the integration voltage is less than third divided voltage, the switching NMOS transistor is turned off, and the LED current is increased.

15. A LED lighting system, comprising:

a LED; and a switching regulator, comprising:

a controller;

a current sensing resistor, one end thereof is used to receive a input voltage, and other one end thereof is connected to an anode of the LED;

an inductor, one end thereof is connected to a cathode of the LEDD; and a Zener diode, an anode and a cathode thereof are respectively connected to other one end of the inductor and the end of the current sensing resistor;

wherein the controller is connected to the current sensing resistor and the other one end of the inductor, and the controller comprises:

a current monitor, used to sense a LED current passing through the current sensing resistor, and to generate a sensing current; and a voltage divider, connected to the current monitor, used to receive the sensing current to generate a first through third divided voltages, wherein the first divided voltage is larger than the second divided voltage, and the second divided voltage is larger than the third divided voltage;

an integration circuit, connected to the voltage divider, used to compare the second divided voltage with a reference voltage, and to generate an integration voltage across a RC circuit thereof accordingly; and a comparator circuit, connected to the integration circuit and the voltage divider, used to compare the integration voltage with the first divided voltage and the third divided voltage, and to generate a driving signal.

16. The LED lighting system according to claim 15, wherein the current monitor comprises:

a first resistor, one end thereof is connected to an input voltage and one end of the current sensing resistor;

a first operation amplifier, a positive input end thereof is connected to other one end of the current sensing resistor, and a negative input end thereof is connected to other one end of the first resistor; and a NMOS transistor, a drain end thereof is connected to the other one end of the first resistor, a source end is connected to the voltage divider, and a gate end thereof is connected to an output end of the first operation amplifier.

17. The LED lighting system according to claim 15, wherein the integration circuit comprises the RC circuit and a second operation amplifier, wherein an positive input end of the second operation amplifier is used to receive the second divided voltage, a negative input end of the second operation amplifier is used to receive the reference voltage, and an output end of the second operation amplifier is connected to the RC circuit.

18. The LED lighting system according to claim 15, wherein the comparator circuit comprises a comparator with a positive input end and two negative input ends, wherein the positive input end of the comparator is used to receive the integration voltage, and two negative input ends of the comparator are used to receive the first divided voltage and the second divided voltage.

19. The LED lighting system according to claim 17, further comprising:

a logic circuit, connected to the comparator circuit, used to receive the driving signal, and to generate a switching signal accordingly; and a switching NMOS transistor, a gate end thereof is used to receive the switching signal, and a drain end thereof is connected an inductor of the switching regulator, wherein a LED of the LED lighting system is connected between the current sensing resistor and the inductor.

20. The LED lighting system according to claim 19, wherein when the second divided voltage is larger than the reference voltage, the integration voltage is increased, when the second divided voltage is not larger than the reference voltage, the integration voltage is decreased; when the integration voltage is larger than first divided voltage, the switching NMOS transistor is turned on, and the LED current is decreased, when the integration voltage is less than third divided voltage, the switching NMOS transistor is turned off, and the LED current is increased.

* * * * *